United States Patent [19]

Hiatt

[11] 4,103,609

[45] Aug. 1, 1978

[54] METAL CAN PELLETIZER

[76] Inventor: Martin H. Hiatt, 993 Vernon Ave., Venice, Calif. 90291

[21] Appl. No.: 749,887

[22] Filed: Dec. 13, 1976

[51] Int. Cl.[2] ..... B30B 1/18; B30B 15/32

[52] U.S. Cl. ..... 100/218; 100/DIG. 2; 100/232; 100/256; 100/257; 100/289; 100/295

[58] Field of Search ..... 100/DIG. 2, 218, 289, 100/290, 256, 257, 232, 42, 295

[56] References Cited

U.S. PATENT DOCUMENTS

| | | | |
|---|---|---|---|
| 1,932,041 | 10/1933 | Jacobson | 100/232 |
| 2,244,078 | 6/1941 | Perlberg | 100/232 |
| 3,204,550 | 9/1965 | Swiderski | 100/DIG. 2 |
| 3,352,230 | 11/1967 | Hunnicutt | 100/DIG. 2 |
| 3,976,002 | 8/1976 | Gerlach | 100/DIG. 2 |

*Primary Examiner*—Billy J. Wilhite

*Attorney, Agent, or Firm*—M. Wayne Western

[57] ABSTRACT

A compactor for metal cans, particularly beverage cans, which consists of a housing and a lid containing therein a primary chamber cavity terminating at one end in transversely extending cavity extension. With the can in position in the chamber a motorized longitudinal ram crushes the can in a longitudinal direction into the shape of a disc whereupon a cross ram operating in the cavity extension transversely crushes the disc into a pellet. In operation of the device the power driven longitudinal ram compresses the can to a predetermined point whereupon the power driven cross ram automatically starts and the longitudinal ram automatically stops. When maximum compaction has been obtained both rams automatically withdraw to their original position and the pellet falls through an opening in the floor of the cavity extension.

3 Claims, 5 Drawing Figures

METAL CAN PELLETIZER

BACKGROUND OF THE INVENTION

This application relates to a compactor for metal cans, including beverage cans and the like. More specifically this invention relates to a compactor having two rams which crush the can into a compact pellet.

With the current emphasis on recycling metals, bottles, paper and the like, there has arisen a need for an apparatus that will serve to reduce the size of metal cans, making them more compact and easier to transport. More and more beverages are being packaged in aluminum cans which are recyclable but which require a considerable amount of storage. There are numerous purchasing centers located to purchase and recycled metal cans but, because of the bulk, many people are unwilling to transport empty beverage cans to such centers.

OBJECT OF THE INVENTION

It is an object of the present invention to provide a simple compactor whch is capable of crushing a metal can into a pellet.

It is also an object of the present invention to provide a compactor for metal cans which will crush the cans longitudinally into a disc and then transversely into a pellet that will fall from a compactor by gravity when the compacting means are released.

A still further object of the present invention is to provide a compactor for metal cans, aluminum beverage cans in particular, wherein the crushing means are motorized and which cooperate sequentially in crushing the can and thus reducing its volume.

An additional object of the invention is to provide a compactor for beverage cans and the like which can be placed on a bar, a kitchen counter, or the like.

These and other objects may be accomplished by means of a compactor the principle features of which include a housing, preferably including a lid, forming a chamber therein adapted to receive a metal can. One end of the chamber opens into a transversely extending cavity extension. A motorized primary ram extending into the chamber will, when actuated, compress the can longitudinally into a disc, with ram movement terminating at the intersection of the chamber with the cavity extension. A switch serves to stop the ram movement in the chamber and at the same time to actuate a motor operating a cross ram in the transversely extending cavity section. The ram in the cavity section crushes the disc formed in the chamber into a pellet. The cross ram is stopped by a switch at a predetermined point, whereupon both rams reverse direction, returning to their starting point, while the crushed or pelletized can drops through an opening in the bottom of the cavity extension for collection. These and other objects will become apparent from the following detailed description of the drawings.

DRAWINGS

DETAILED DESCRIPTION OF THE INVENTION

Figure 1:
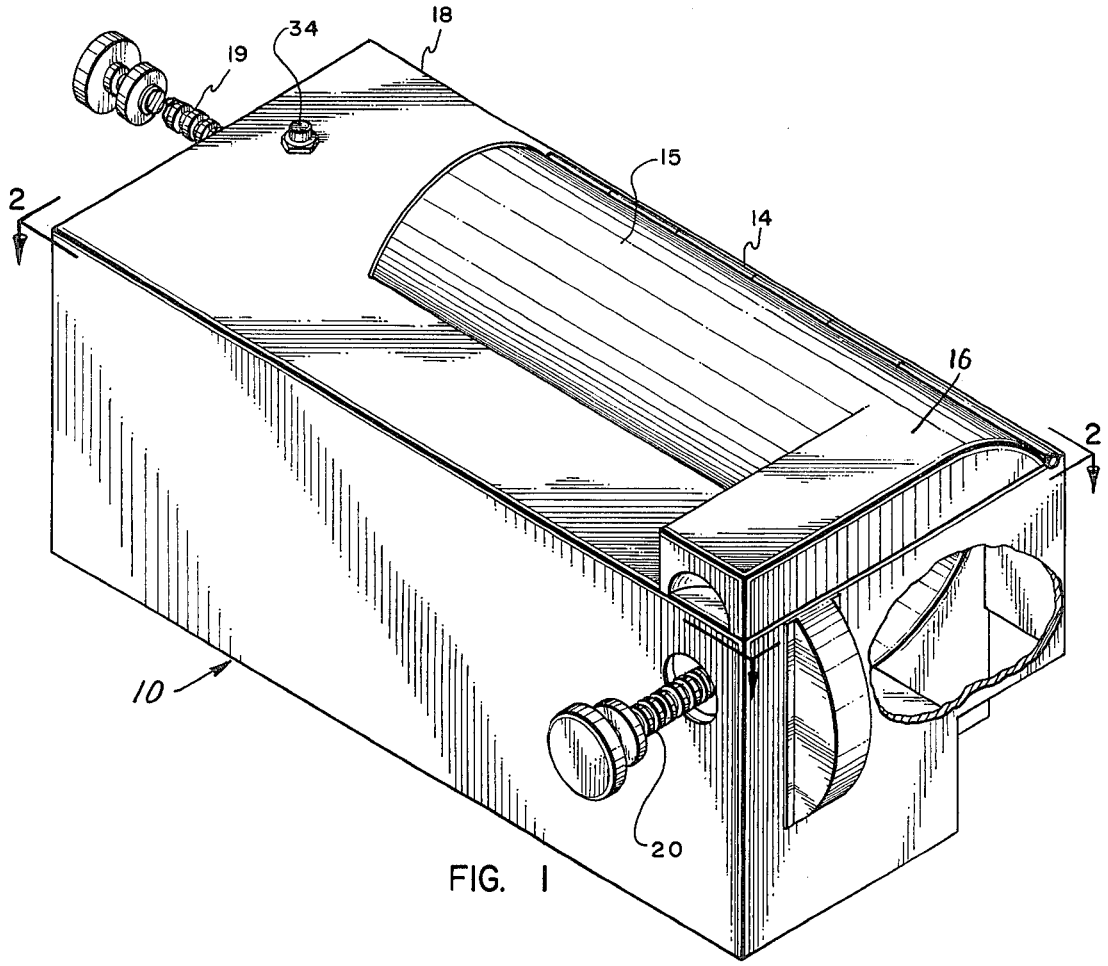
FIG. 1 is a perspective view of one embodiment of a compactor of the invention, with the lid in a closed position and a wall partially broken away to show the interior portions of the cavity extension.

There is shown in FIGS. 1 to 4 a complete operative embodiment of the invention as presently preferred. The compactor consists of a housing 10 of any desired shape. Preferably the housing is adapted to fit on a bar, on a counter top or perhaps even be hung on a wall. Within the housing is a chamber 11 terminating at one end in a transversely extending cavity 12. A portion of the floor 13 in cavity 12 is open to allow the pellet to be removed, as will be explained in detail hereinafter.

Preferably connected to the housing by means of hinges 14 is a lid 15 adapted to fit over chamber 11 and cavity 12. Within lid 15 is an overlying rectangular cavity portion 16 that is similar to cavity 12. At the opposite longitudinal side of the lid are fastening means (not shown) to lock the lid in place while the compactor is in operation. The locking means may be in the form of clasps, ties, buckles, frictional engagement or any other type which will not allow the lid to swing open or become free during the compaction process. If desired a plurality of locking means may be used.

With the lid closed a closed cavity here shown as being of cylindrical configuration, is formed between chamber 11 and lid 15 which cylindrical cavity is longitudinal in shape and which will have a diameter as large as, or slightly larger than, the can to be compacted.

Power driven rams 17 and 18 extend into housing 10. Ram 17 is connected to a driving rod 19 which is positioned to drive the ram 17 in a longitudinal direction with chamber 11, thereby compacting the can into a disc. Likewise the cross ram 18 is connected to a driving rod 20 which functions to drive the ram within cavity 12 to further compact the disc into a pellet.

Figure 2:
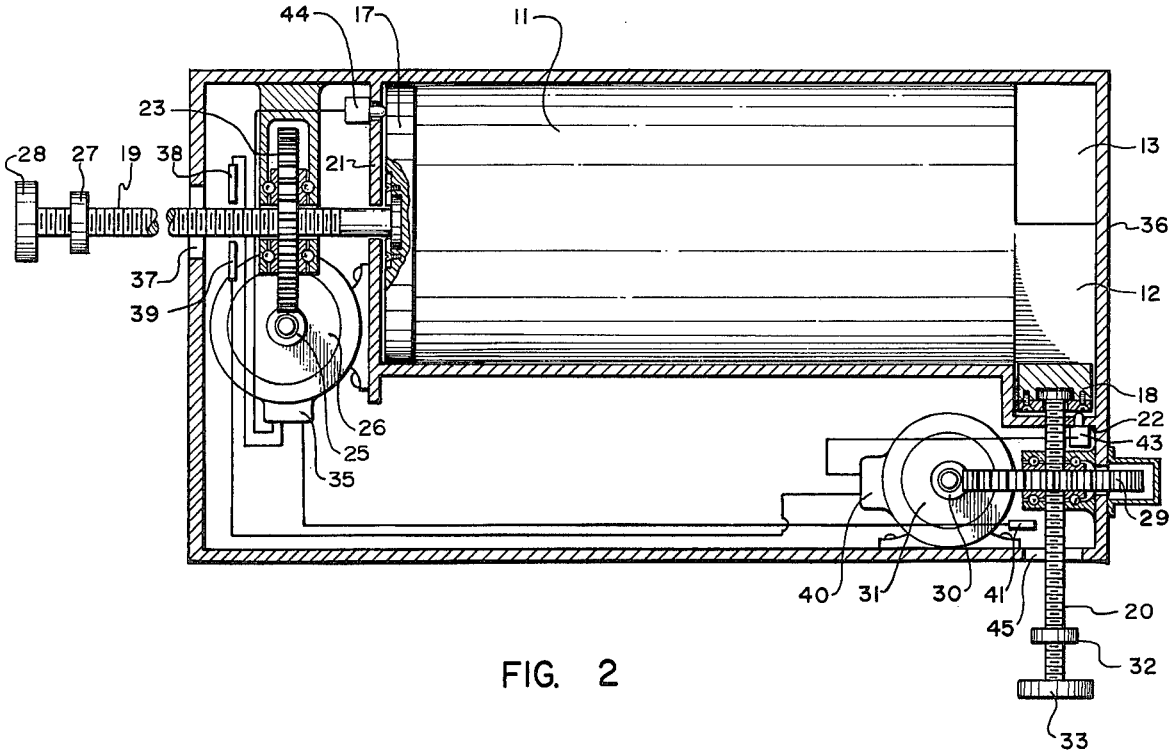
FIG. 2 is a horizontal cross sectional view of the compactor shown in FIG. 1 taken along lines 2—2 with the primary and cross rams in an open position.
Figure 3:
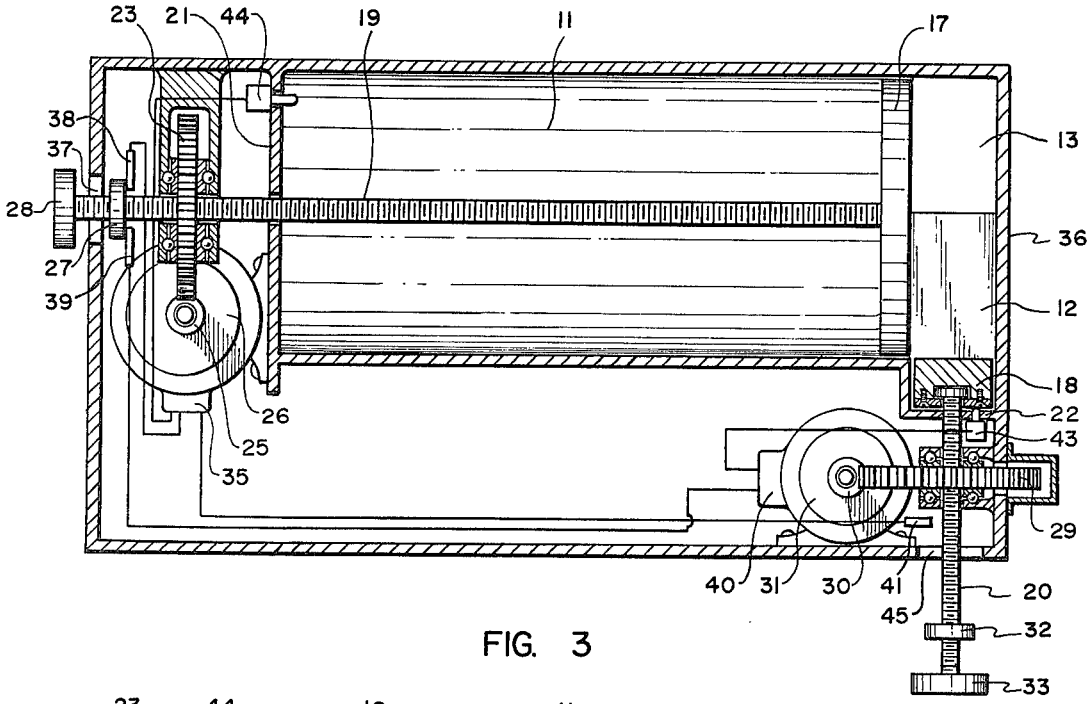
FIG. 3 is a horizontal cross sectional view similar to FIG. 2 with the primary ram in a closed position.
Figure 4:
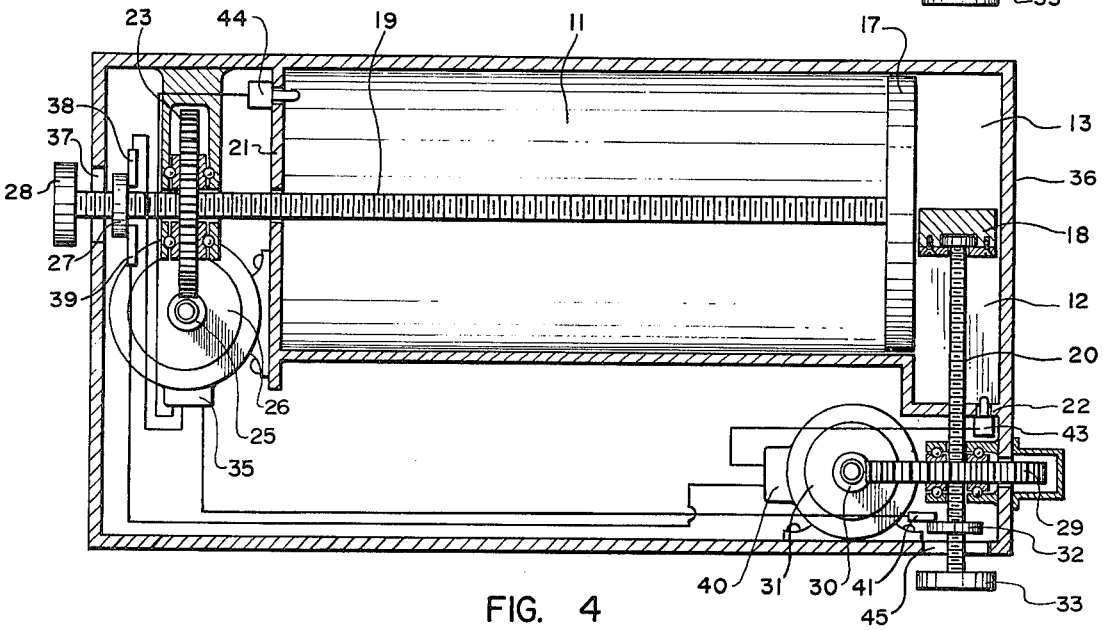
FIG. 4 is a horizontal cross sectional view similar to FIG. 3 with both rams in a closed position.
Figure 5:
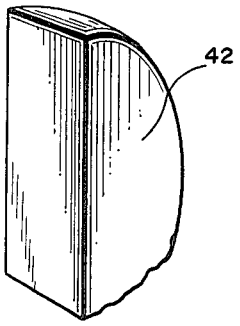
FIG. 5 is a perspective view of a pellet formed by utilization of the compactor as illustrated.

FIG. 2 shows the rams in an open or starting position with ram 17 adjacent a chamber end wall 21. Likewise the cross ram 18 is held back in starting position adjacent a cavity end wall 22.

Drive rod 19 is preferably swivelly connected to ram 17 and is threaded to pass through intermeshing threads in an aperture in the center or worm wheel 23. Worm wheel 23, as illustrated, is an exteriorly toothed gear in engagement with worm gear 25 which is connected to the drive shaft of motor 26. The longitudinal driving rod 19 contains a threaded nut 27 which may or may not be adjustable. Though, not necessary for the operation of the device, the drive rod 19 preferably contains a knob or other fixture at the end to make it more appealling to the eye.

Similarly to ram 17, cross ram 18 contains a driving rod 20 which is preferably swivelly engaged with ram 18 and which is also threaded to intermesh with threads in an aperture in the center of worm wheel 29 which, as illustrated, is in engagement with worm gear 30 connected to the drive shaft of motor 31. The drive rod 20 also contains a threaded nut 32 which may or may not be adjustable. A knob 33 is also preferably contained at the end of drive rod 20 for aesthetic purposes.

With the major components now defined the operation of the compactor can be described.

To place the compactor into operation the lid 15 is raised and a can is placed into chamber 11 in the housing and the lid 15 is then closed and locked thus encasing the can within the closed cavity. Switch 34 as illustrated in FIG. 1, which may be a resetting push button or toggle switch, is connected to switch 35 by wires, not shown. Switch 35 is a reversible switch which actuates motor 26, which is also a reversible motor. The actuation of motor 26 causes worm 25 and worm wheel 23 to rotate. As the worm gear and worm wheel rotate the drive rod 19 moves ram 17 which as a diameter approximately the same as the diameter of the closed cavity thereby forcing the can against end wall 36 and upon further movement causes the can to be crushed or compacted into a disc in the cavity extension until ram 17 reaches the intersection of the chamber with the cavity extension. In order to stop the ram at that point the threaded nut 27 is adjusted to pass through an opening 37 in the housing and come into contact with limit switches 38 and 39. Limit switch 38 relays a signal to switch 35 which stops operation of motor 26 while at the same time the switch 39 relays a signal to reversible switch 40 thereby causing motor 31 to be actuated. As motor 31 is actuated worm gear 30 turns worm wheel 29 thereby forcing the threads on drive rod 20 through worm wheel 29 pushing ram 18 in a transverse direction. Ram 18 is sized to fit within end wall 22 of the cavity extension and is substantially of the same width and height. The width of ram 18 is more effectively illustrated in FIGS. 3 and 4. Ram 18 is driven in a transverse direction relative to the chamber 11 until threaded nut 32 comes into contact with limit switch 41 which sends a signal to both reversible switches 35 and 40 to actuate and reverse the direction of motors 26 and 31 thereby withdrawing both the transverse and primary rams to their starting positions. The compressed pellet 42 thus formed falls through aperture 13 in the open floor of the rectangular portion of the housing 10 for collection purposes. Cross ram 18 is withdrawn until the ram comes into contact with switch 43 which stops motor 31 and resets switch 40 for reuse when the next can is inserted into chamber 11 for compaction. Likewise ram 17 is withdrawn until it comes into contact with switch 44 wherein operation of motor 26 is stopped and switch 35 is reset to begin operation when another can is placed into chamber 11 for compaction. An opening 45 in housing 10 may be necessary to allow nut 32 to come into contact with switch 41. The circuitry and wiring have not been detailed as they are deemed to be obvious to one with ordinary skill in the art. The novel sequence of operations and the interaction between the compacting rams is believed to present a novel advance over the art which is economically practical. It is realized that other configurations and shapes may be used and that the gearing arrangements may be changed without altering the scope or purpose of the present invention.

Thus, while the invention as has been described is deemed to be that which would form the preferred embodiment it is recognized that departures may be made therefrom without departing from the scope of the invention, which is not to be limited to the details disclosed, but is to be accorded the full scope of the claims so as to include any and all equivalent devices and apparatus.

I claim:

1. A compactor for metal cans comprising (a) a housing containing therein a closeable longitudinal cavity with a lid and having a forward endwall, said cavity opening at the opposite end into a cavity extension, said longitudinal cavity and cavity extension being adapted to receive a metal can, (b) a power driven primary ram in the longituindal cavity, a primary driving rod and primary power means wherein the primary driving rod interconnects the primary ram with the primary power means, said driving rod passing through the forward endwall of the housing portion of said longitudinal cavity, said ram having the diameter the same as the diameter of the longitudinal cavity and wherein said power means is adapted to drive the primary ram a predetermined distance to the opposite end of the longitudinal cavity, (c) said transverse extension forming an extension of the longitudinal cavity being substantially rectangular in shape having an endwall, a rectangular sidewall, and opposing endwall, and floor which is partially open, (d) a power driven transverse ram in the cavity extension at right angles to the primary ram, a transverse driving rod and transverse power means wherein the transverse driving rod interconnects the transverse ram with the transverse power means said driving rod passing through the endwall of said cavity extension and wherein said transverse power means is adapted to drive the transverse ram a predetermined distance across the cavity extension and means to reverse the direction of the primary ram and transverse ram.

2. A compactor according to claim 1, wherin the primary ram and transverse ram are swivelly connected to their respective driving rods.

3. A compactor according to claim 2 wherein the primary and transverse power means consist of electric motors and reversible switching means connected to the driving rods.

* * * * *